US008912902B1

(12) United States Patent
Xu

(10) Patent No.: US 8,912,902 B1
(45) Date of Patent: Dec. 16, 2014

(54) LOOKDOWN ENABLE/DISABLE FOR DETECTORS

(71) Applicant: Honeywell International Inc., Morristown, NJ (US)

(72) Inventor: Guobin Xu, Guangdong (CN)

(73) Assignee: Honeywell International, Inc., Morristown, NJ (US)

( * ) Notice: Subject to any disclaimer, the term of this patent is extended or adjusted under 35 U.S.C. 154(b) by 34 days.

(21) Appl. No.: 13/906,851

(22) Filed: May 31, 2013

(51) Int. Cl.
*G08B 13/00* (2006.01)

(52) U.S. Cl.
CPC ..... *G08B 13/00* (2013.01)
USPC ..... 340/541; 340/552; 340/565; 340/693.5; 250/342

(58) Field of Classification Search
CPC ..... G08B 13/00; G08B 13/18
USPC ..... 340/541, 545.1, 545.2, 552, 561, 565, 340/693.5, 693.6; 250/342
See application file for complete search history.

(56) References Cited

U.S. PATENT DOCUMENTS 8,258,478 B2 9/2012 Walters et al.

*Primary Examiner* — Jeffery Hofsass
(74) *Attorney, Agent, or Firm* — Wood, Phillips, Katz, Clark & Mortimer

(57) ABSTRACT

An intrusion detector comprises a housing including a cover and baseplate mounting a circuit board. The cover and baseplate are removably mountable to a base. A motion sensor and bracket are mounted to the circuit board. The cover has a lower lookdown window. A lookdown enable/disable actuator extends from a rear side of the circuit board and is accessible through the baseplate. The actuator is operable to move a door pivotally mounted to the bracket between an on position to enable a lookdown function and an off position to disable the lookdown function. The detector is normally mounted on a wall by securing the base to the wall. The cover and baseplate can be removed from the base. A screwdriver can be used to turn the actuator. The cover and baseplate can then be remounted to the base.

14 Claims, 4 Drawing Sheets

LOOKDOWN ENABLE/DISABLE FOR DETECTORS

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD

This application relates generally to intrusion detectors and, more particularly, to apparatus for selectively enabling and disabling a lookdown function.

BACKGROUND

Home security and monitoring systems have become commonplace as people seek to protect themselves and their property. Home security systems typically employ sensors at entry points, such as windows and doors, along with interior sensors such as motion detectors. The motion detectors may use infrared and/or microwave signals to detect motion proximate the detector. Typically, the detector includes a lens in the cover for detecting motion in an area in front of the detector. Intrusion detectors may include a lookdown function with a lens positioned in the bottom of the cover for detecting motion beneath the detector.

In some applications it may be necessary or desired to disable the lookdown function. Traditionally, there are two methods to disable the lookdown function. The first method uses a black thin label to mask the lookdown window. In order to enable the lookdown function it is necessary to disassemble the detector, remove the label, then reassemble the detector. The second method uses a rubber band to mask the lookdown mirror. To enable the lookdown function, it is necessary to disassemble the detector, remove the band from the mirror, then reassemble the detector. Both the label and rubber band are removed from the detectors and stored outside of the detectors.

There are two shortcomings with these methods. One, it is necessary to fully disassemble the detector, remove the label or rubber band, then reassemble the detector. This operation can be complicated and also exposes the internal circuitry. Secondly, there is a need to store the label or rubber band outside of the detector in the event it is necessary to later disable the lookdown function. However, once outside the detectors, the label or rubber band may be easy to lose.

SUMMARY

As described herein, an intrusion detector comprises a housing including a circuit board having front and rear sides and a cover mounting the circuit board to cover the front side and to define an interior space. The cover has a lower lookdown window. A bracket is mounted to the front side of the circuit board. The bracket has opposite side walls with one of the side walls having a pair of pivot tabs at a lower end defining an axis perpendicular with the circuit board and aligned with an opening in the circuit board. A motion sensor is mounted to the circuit board between the bracket opposite side walls and aligned to detect motion visible through the lower lookdown window. A door is hingedly mounted to the pivot tabs. An actuator is located at the rear side of the circuit board and is connected to the door through the opening. The actuator is operable to move the door between an on position to enable a lookdown function, and an off position to disable the lookdown function.

It is a feature that in the on position the door extends between the side walls to mask the motion sensor relative to the lower lookdown window.

It is another feature that the motion sensor is angularly mounted relative to the circuit board to sense motion in front of and below the cover and the cover includes a front lens.

It is another feature that the pivot tabs are parallel to the circuit board and include aligned pivot openings and the door includes a rod extending through the pivot openings. The rod extends through the circuit board opening and is received in the actuator.

It is a further feature that the actuator moves the door about 115° between the on and off positions.

It is yet another feature that the actuator includes a slot accessible from the rear side of the circuit board for receiving a driver tool.

It is an additional feature that the door comprises a generally rectangular plate and a rod connected to one end of the plate. The rod extends through the circuit board opening and pivotally engages the pivot tabs. The rod may have a squared end received in a squared notch in the actuator.

It is still a further feature that a housing base is mountable to a wall and the cover is removably mounted to the housing base. A baseplate may be mounted to the cover to overly the circuit board.

It is yet another feature that the door and side walls are configured so that in the off position the motion sensor is surrounded on three sides and detects motion only from in front of the cover.

Other features and advantages will be apparent from a review of the entire specification, including the appended claims and drawings.

DETAILED DESCRIPTION

Figure 2:
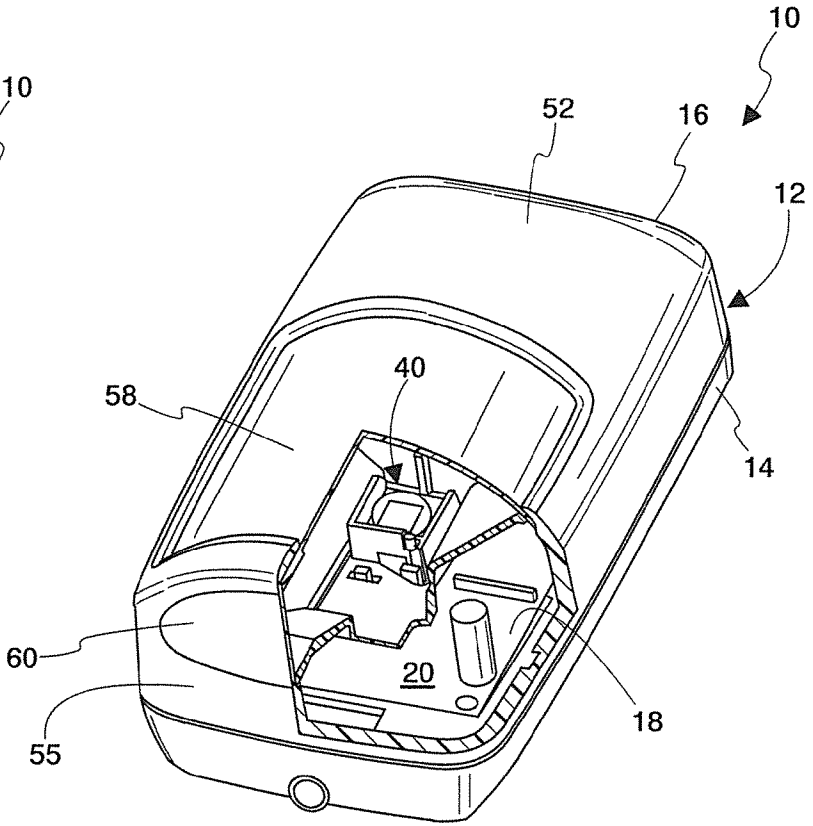
FIG. 2 is a perspective view of the intrusion detector of FIG. 1 with a part cut away to illustrate the structure implementing the lookdown enable and disable function.
Figure 1:
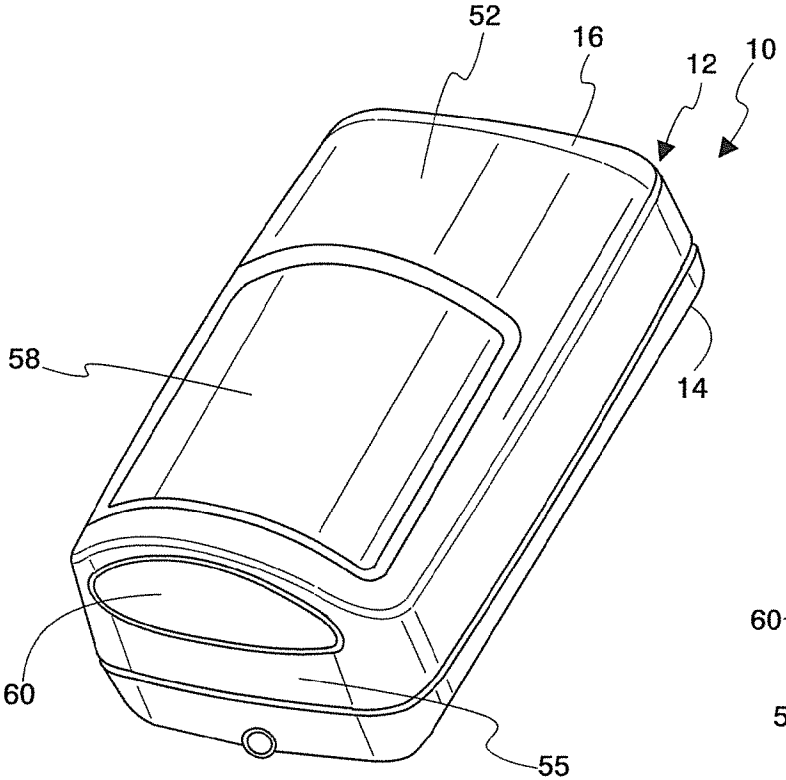
FIG. 1 is a perspective view of an intrusion detector having a lookdown enable and disable function.
Figure 3:
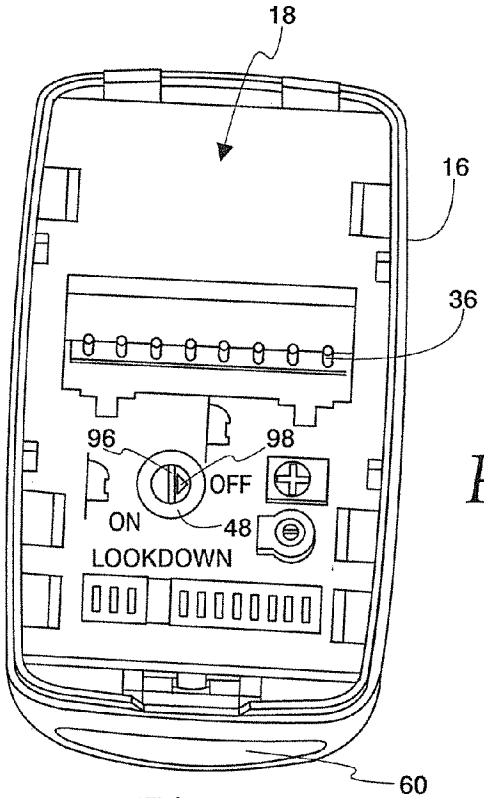
FIG. 3 is a rear view of a cover and backplate of the intrusion detector of FIG. 1 removed to access a lookdown function actuator.
Figure 6:
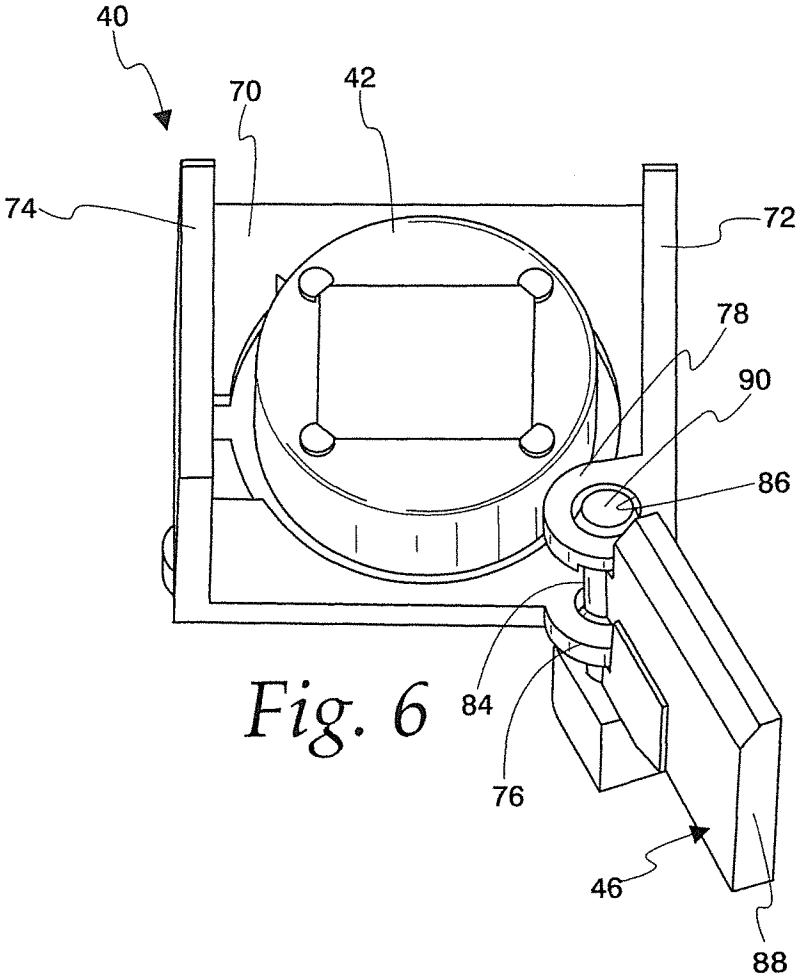
FIG. 6 is a perspective view of the lookdown door in an on position.
Figure 5:
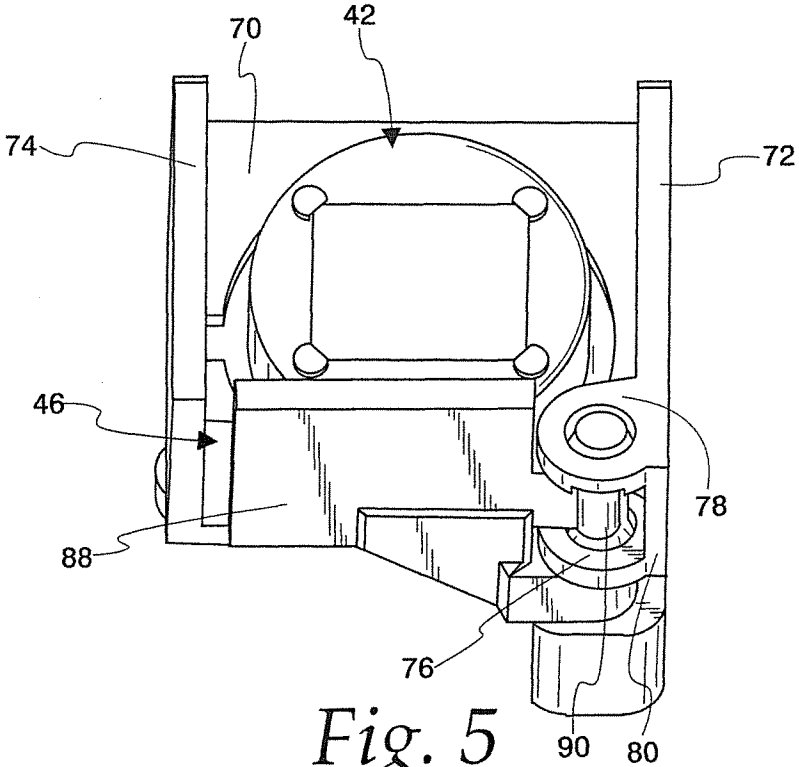
FIG. 5 is a perspective view of a lookdown door in an off position.
Figure 8:
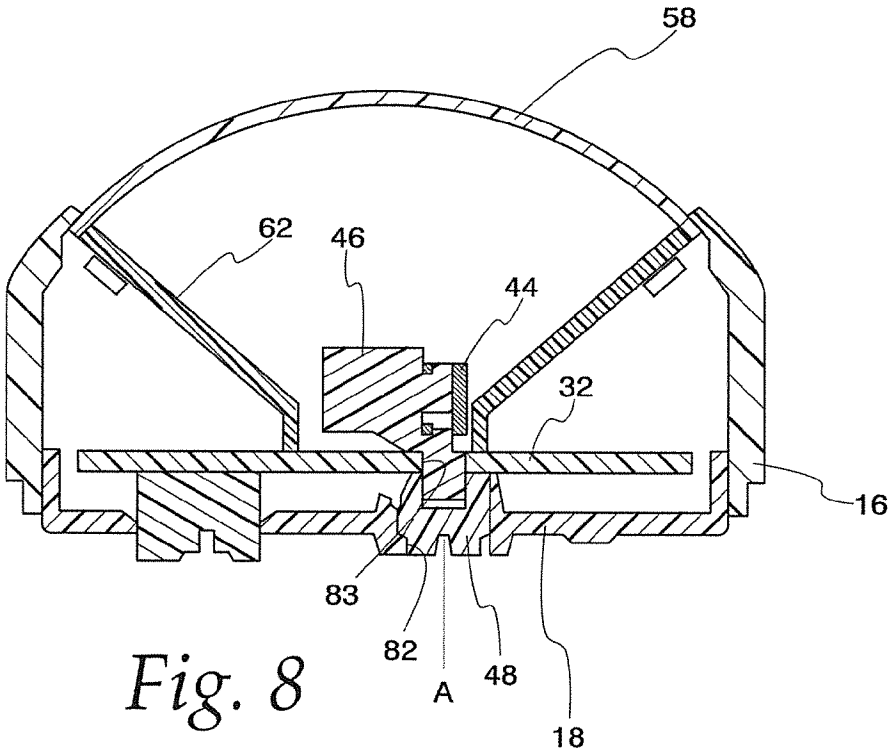
FIG. 8 is a sectional view of the intrusion detector illustrating the sensor assembly.
Figure 7:
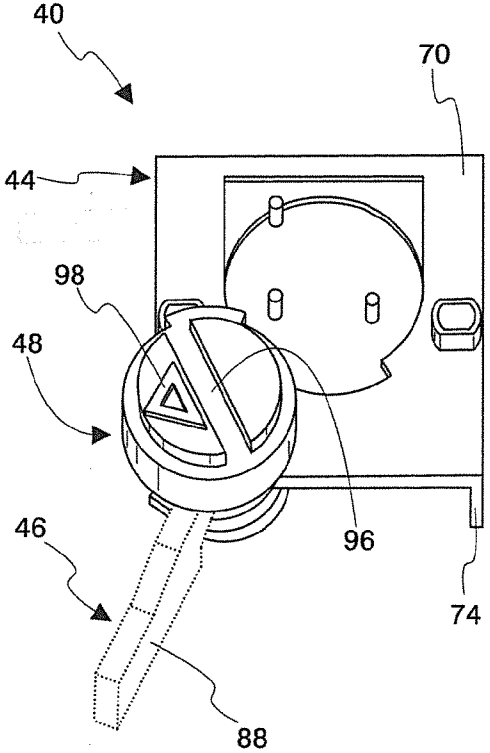
FIG. 7 is a rear view of the sensor assembly illustrating the actuator and door.

FIG. 1 illustrates an intrusion detector 10 having a lookdown function which can be selectively enabled or disabled, as described more particularly below. The intrusion detector 10 includes a housing 12 including a base 14 and a cover 16. The base 14 is adapted to be wall mounted in any known manner with the cover 16 selectively removable therefrom, as generally illustrated in FIG. 3. The housing 12 also includes a baseplate 18 removably mounted to the cover 16 to define an interior space 20, see FIG. 2. When the cover 16 is removed from the base 14, the baseplate 18 remains secured to the cover 16 but can subsequently be removed therefrom.

Figure 4:
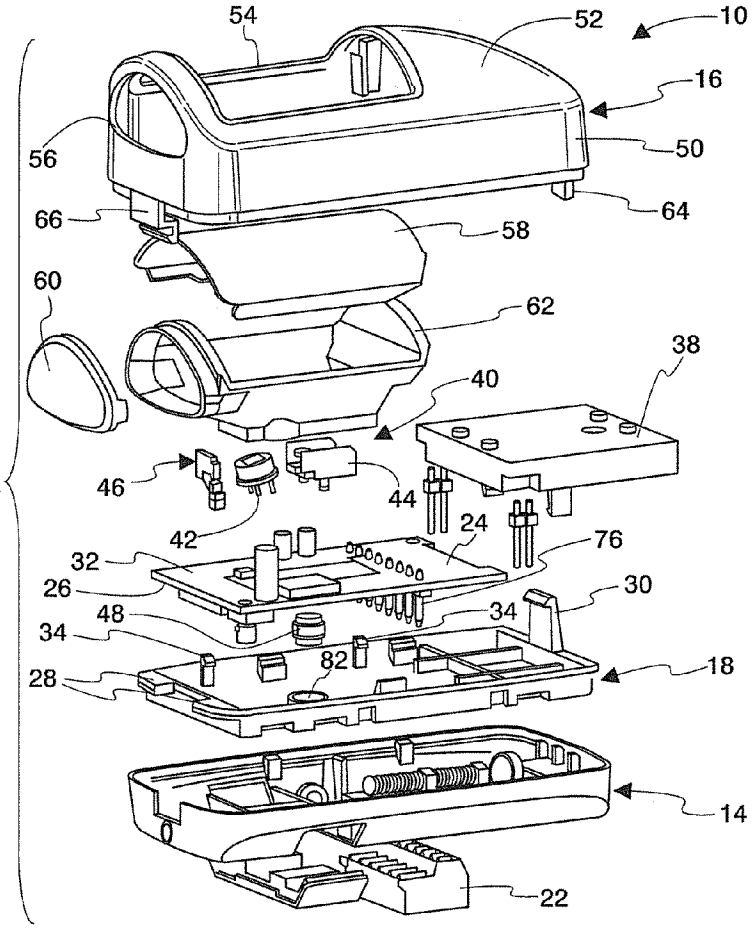
FIG. 4 is an exploded view of the intrusion detector of FIG. 1.

Referring to FIG. 4, a terminal block 22, defining a receptacle, is provided for electrical connection to external control apparatus. The terminal block 22 mounts to the base 14. The base 14 is selectively mounted to a wall. When the cover 16 is mounted to the base 14 electrical connections are made to circuitry mounted to the baseplate 18, as described below.

The baseplate 18 is of a size to be received within the cover 16, as shown in FIG. 3. The baseplate includes tabs 28 at a lower end and a latch 30 at an upper end.

A printed circuit board 32 is mounted to the baseplate 18 using tabs 34. The circuit board 18 includes a front side 24 and a rear side 26. The circuit board 32 includes circuits for controlling operation of the intrusion detector 10 and pins 36 that plug into the terminal block 22 incident to the cover 16 being mounted to the base 14. A microwave module 38 is mounted to the printed circuit board 32 and is secured by the latch 30 and forms part of the electrical circuit. A sensor assembly 40 is also mounted to the front side 24 the circuit board 32. The sensor assembly 40 includes a motion sensor 42, a bracket 44, a lookdown door 46, and a lookdown actuator 48. The motion sensor assembly 42 is used to sense motion and provide a signal to the electrical circuitry to selectively indicate an alarm condition, as is known. This application is not directed to the electrical circuit per se, but rather to structure for selectively enabling the lookdown function. Thus, the electrical circuit is not described herein.

The cover 16 is of a size to be received on the base 14. The cover 16 includes a peripheral wall 50 connected to a front wall 52. The front wall 52 has a front opening 54. A bottom end 55 of the peripheral wall 50 includes a lookdown opening 56. A front lens 58 is selectively received in the front opening 54 and a lookdown lens 60 is selectively received in the lookdown opening 56. Particularly, both lenses 58 and 60 are mounted to a bug guard 62. The bug guard 62 is adapted to provide an open space, within the interior space 20, see FIG. 2, between the lenses 58 and 60 and the sensor assembly 40. As such, the sensor assembly 40 is effectively shielded from the outside so that only motion visible through the lenses 58 and 60 is detected thereby. The cover 16 includes upper tabs 64 for engaging the base 14 and a flexible latch 66 used for selectively removing the cover 16 from the base 14, as will be apparent.

As is apparent, the housing 12 could include alternative configurations, as necessary.

The sensor assembly 40 is illustrated in greater detail in FIGS. 5-8. The bracket 44 comprises a rear wall 70 and opposite side walls 72 and 74. The first side wall 72 includes a pair of pivot tabs 76 and 78 at a lower end 80 defining an axis "A", see FIG. 8, aligned with an opening 82 in the baseplate 18 and an opening 83 in the circuit board 32. The pivot tabs 76 and 78 are parallel to the circuit board 32 and include respective pivot openings 84 and 86.

The lookdown door 46 comprises a generally rectangular plate 88 integral with a rod 90. The rod 90 is selectively mounted in the pivot openings 84 and 86. The rod 90 includes a squared rear end 92 receivable in a squared notch 94 of the actuator 48. The actuator 48 includes a slot 96 for accessing with a drive tool, such as a screwdriver.

The motion sensor 42 is mounted to the bracket rear wall 70 between the side walls 72 and 74. The motion sensor 42 is angularly mounted so that it can detect motion through both the lookdown lens 60 and the front lens 58. The motion sensor 42 is then soldered to the circuit board 32. The rod 90 extends through the circuit board opening 83 and is secured to the actuator 48. The circuit board 32, including the bracket 44 and the motion sensor 42, is then mounted to the baseplate 18. The actuator 48 is accessible through the baseplate opening 82. The baseplate 18 is then mounted to the cover 16. The resultant assembly is illustrated in FIG. 3. The cover 16 can then be mounted to the base 14 as shown in FIGS. 1 and 2.

As described above, the actuator 48 is mounted to the rod 90 of the door 46. The rod 90 is also pivotally mounted to the pivot tabs 76 and 78. The actuator 48 is accessible at the rear of the baseplate 18, see FIGS. 3, and 8, and is selectively rotated to move the door 46 between an "on" position to enable a lookdown function, see FIG. 6, and an "off" position to disable the lookdown function, see FIG. 5. Particularly, in the "off" position the plate 88 extends between the side walls 72 and 74 so that the motion sensor 42 is masked relative to the lookdown lens 60. In the "on" position, the motion sensor 42 is not masked, and thus the lookdown lens 60 is visible. The door 46 is movable in a range of about 115°, as is illustrated comparing FIGS. 5 and 6, to provide a wider angle of visibility through the lookdown lens 60.

With the described structure, the lookdown function can be enabled or disabled simply by removing the cover 16 from the base 14, as shown in FIG. 3, to expose the baseplate 18. In this position, the actuator 48 is visible to the user and can be rotated to move the door 46. The actuator 48 includes an indicator tab 98 which points to "ON" or "OFF" indicators on the baseplate 18. Thus, the lookdown function can be enabled or disabled without having to expose the electrical circuitry or the sensor 42, and the cover 16 can then be remounted to the base 14.

Thus, as described, the intrusion detector 10 comprises a housing 12 including a cover 16 and baseplate 18 mounting a circuit board 32. The cover 16 and baseplate 18 are removably mountable to a base 14. A motion sensor 42 and bracket 44 are mounted to the circuit board 32. The cover 16 has a lower lookdown window 60. A lookdown enable/disable actuator 48 extends from a rear side 26 of the circuit board 32 and is accessible through the baseplate 18. The actuator 48 is operable to move a door 46 pivotally mounted to the bracket 44 between an on position to enable a lookdown function and an off position to disable the lookdown function. The detector 10 is normally mounted on a wall by securing the base 14 to the wall. The cover 16 and baseplate 18 can be removed from the base 14, while the base 14 remains secured to the wall. A screwdriver can be used to turn the actuator 48. The cover 16 and baseplate 18 can then be remounted to the base 14.

In the illustrated embodiment, the motion sensor 42 comprises a dual technology sensor using infrared and microwave sensing. Alternatively, the motion sensor 42 could use passive infrared sensing. The structure for enabling and disabling the lookdown function is not intended to be limited to any particular form of motion sensor.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a single embodiment has been described in detail above, other modifications are possible. For example, other components may be added to, or removed from, the described devices. Other embodiments may be within the scope of the following claims.

The invention claimed is:

1. An intrusion detector comprising:

a housing enclosing a circuit board having front and rear sides and a cover mounting the circuit board to cover the front side and to define an interior space, the cover having a lower lookdown window;

a bracket mounted to the front side of the circuit board, the bracket having opposite side walls with one of the sidewalls having a pair of pivot tabs at a lower end defining an axis perpendicular with the circuit board and aligned with an opening in the circuit board;

a motion sensor mounted to the circuit board between the bracket opposite side walls and aligned to detect motion visible through the lower lookdown window;

a door hingedly mounted to the pivot tabs; and an actuator located at the rear side of the circuit board and operatively connected to the door through the opening, the actuator being operable to move the door between an on position to enable a lookdown function and an off position to disable the lookdown function.

2. The intrusion detector of claim 1 wherein in the off position the door extends between the side walls to mask the motion sensor relative to the lower lookdown window.

3. The intrusion detector of claim 1 wherein the motion sensor is angularly mounted relative to the circuit board to sense motion in front of and below the cover and the cover includes a front lens.

4. The intrusion detector of claim 1 wherein the pivot tabs are parallel to the circuit board and include aligned pivot openings and the door includes a rod extending through the pivot openings.

5. The intrusion detector of claim 4 wherein the rod extends through the circuit board opening and is received in the actuator.

6. The intrusion detector of claim 1 wherein the actuator moves the door about 115 degrees between the on and off positions.

7. The intrusion detector of claim 1 wherein the actuator includes a slot accessible from the rear side of the circuit board for receiving a driver tool.

8. The intrusion detector of claim 1 wherein the door comprises a generally rectangular plate and a rod connected to one end of the plate.

9. The intrusion detector of claim 8 wherein the rod extends through the circuit board opening.

10. The intrusion detector of claim 8 wherein the rod pivotally engages the pivot tabs.

11. The intrusion detector of claim 9 wherein the rod has a squared end received in a squared notch in the actuator.

12. The intrusion detector of claim 1 further comprising a housing base mountable to a wall and the cover is removably mountable to the housing base.

13. The intrusion detector of claim 12 further comprising a baseplate removably mounted to the cover to overly the circuit board.

14. The intrusion detector of claim 1 wherein the door and side walls are configured so that in the off position the motion sensor is surrounded on three sides and detects motion only from in front of the cover.

* * * * *